United States Patent [19]

Humphreys

[11] Patent Number: 4,899,676

[45] Date of Patent: Feb. 13, 1990

[54] AUTOMATIC FLAT SEAMING APPARATUS

[75] Inventor: John C. Humphreys, Hinckley, England

[73] Assignee: H. Flude & Co. (Hinckley) Limited, Leicestershire, England

[21] Appl. No.: 331,593

[22] Filed: Mar. 30, 1989

[30] Foreign Application Priority Data

Mar. 30, 1988 [GB] United Kingdom ..... 8807547

[51] Int. Cl.[4] ..... D05B 21/00

[52] U.S. Cl. ..... 112/121.15; 112/102

[58] Field of Search ..... 112/121.15, 121.11, 112/121.12, 10 A, 2; 223/112

[56] References Cited

U.S. PATENT DOCUMENTS

| | | | |
|---|---|---|---|
| 4,132,183 | 1/1979 | Kienel | 112/121.15 X |
| 4,188,898 | 2/1980 | Bell, Jr. et al. | 112/121.15 X |
| 4,303,026 | 12/1981 | Ueda | 112/121.15 |
| 4,321,881 | 3/1982 | Humphreys | 112/121.15 |
| 4,519,327 | 5/1985 | Selvi | 112/121.15 |
| 4,539,924 | 9/1905 | Bell, Jr. et al. | 112/121.15 X |
| 4,549,493 | 10/1985 | Gazzarrini | 112/121.15 |
| 4,550,868 | 11/1985 | Hodges et al. | 223/112 X |
| 4,570,556 | 2/1986 | Senba | 112/104 X |
| 4,620,494 | 11/1986 | Takatori et al. | 112/121.15 |
| 4,622,909 | 11/1986 | Gazzarrini | 112/121.15 |
| 4,784,070 | 11/1988 | Thurner et al. | 112/121.15 |

*Primary Examiner*—H. Hampton Hunter

*Attorney, Agent, or Firm*—Pearne, Gordon, McCoy & Granger

[57] ABSTRACT

An apparatus for flat seaming together a panti-hose half and a gusset has first and second carriers (16,18). The first carrier is moved from a loading station where a body portion of the panti-hose half is drawn on to the carrier, through an opening station where the body portion is opened along a preselected line extending from the waistband, into a seaming station. The second carrier is moved from the loading station where a gusset is loaded on to the carrier, to the seaming station. Each carrier has respective clamps (24,38), including an array of needles, which serve to grip the body portion and the gusset to their respective carriers. At the seaming station the free edges of the body portion, formed when the latter is opened at the opening station, and the free edge of the gusset are seamed together. Each carrier has a cam (78) which cooperates with a cam surface (80) to align the two carriers relative to one another, and means (74,84) which rotate the two carriers about their central axes to bring successive portions of the free edges of the body portion and gusset together at the seaming station to enable these edges to be sealed together.

15 Claims, 6 Drawing Sheets

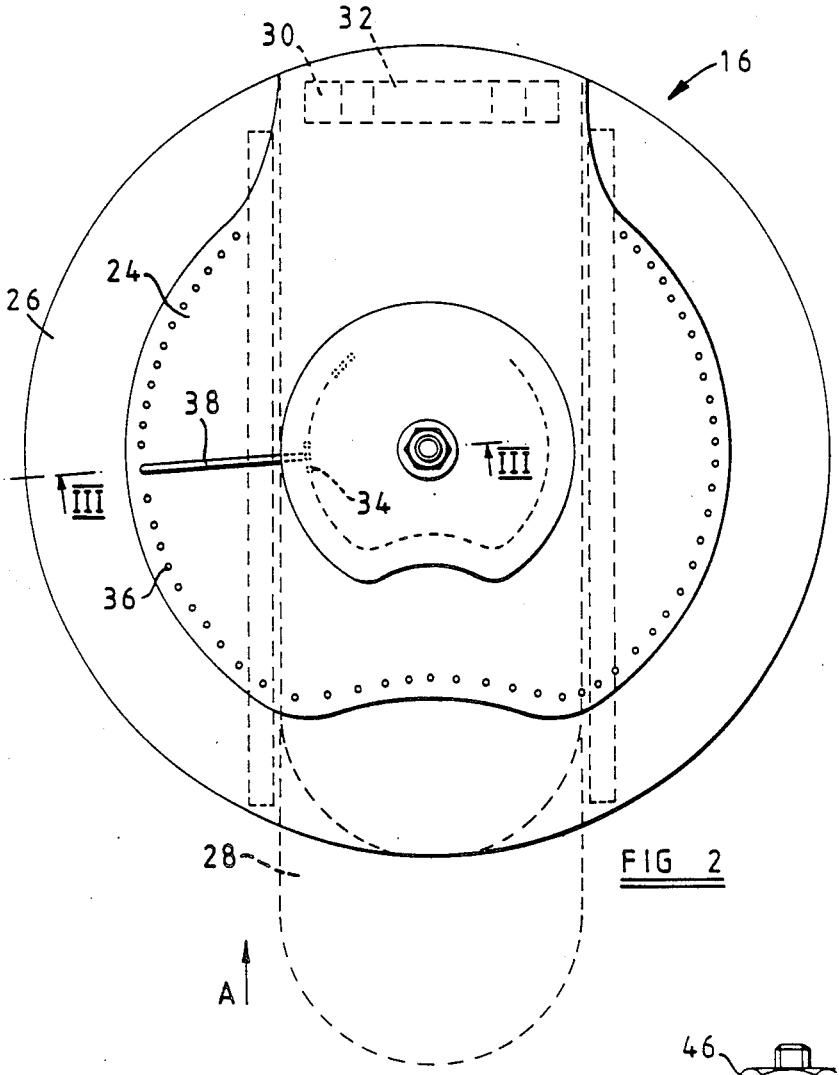
FIG 2
FIG 3
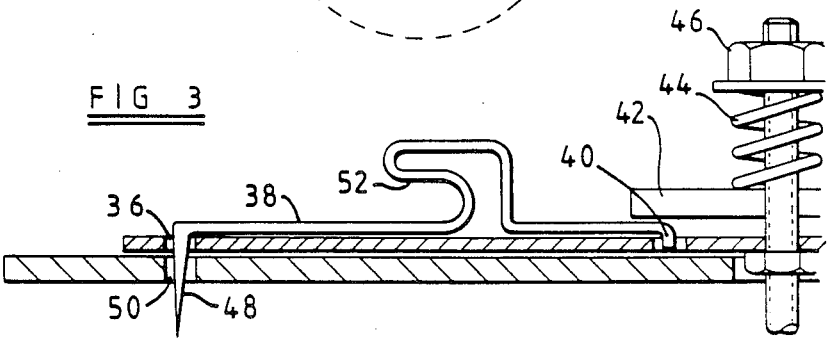

AUTOMATIC FLAT SEAMING APPARATUS

The present invention relates to flat seaming apparatus which may be used in the manufacture of, for example, panti-hose and other related garments where two edges of fabric are to be flat seamed together.

A flat seaming operation on, for example, panti-hose is at present carried out manually on a powered seaming machine, the garment edges being arranged together and presented to the machine needles by an operator. As will be appreciated, this operation is subject to problems of operator fatigue and is dependent on the speed at which the operator can arrange the fabric edges and present these to the machine. A certain degree of skill is therefore necessary.

The present invention seeks to provide a flat seaming apparatus which obviates or reduces the above-mentioned problem.

Accordingly, the present invention provides an apparatus for flat seaming together two garment portions such as panti-hose half and a gusset, comprising:

first carrier means for supporting the body portion of said panti-hose half;

second carrier means for supporting said gusset;

a respective support means for supporting said first and second carrier means and moving said first carrier means successively through a loading station, an opening station and a seaming station and moving said second carrier means through a loading station and said seaming station;

respective clamping means for gripping said gusset and said body portion of said panti-hose half to the respective carrier means;

means at said opening station for opening said body portion along a preselected line extending from a waistband of said body portion to form an opening in said body portion;

means at said seaming station for seaming together free edges of said gusset and said opening in said body portion; and moving means for bringing said first and second carrier means into juxtaposition to align said free edges with one another at said seaming station and means for moving said carrier means relative to one another and to said seaming means to bring successive portions of said edges in juxtaposition during seaming to enable said seaming means to seam said edges together.

The present invention is further described hereinafter, by way of example, with reference to the accompanying drawings, in which:

FIG. 2 is a plan view of a rotatable head of FIG. 1;

FIG. 3 is a section along the line III—III FIG. 2;

Figure 1:
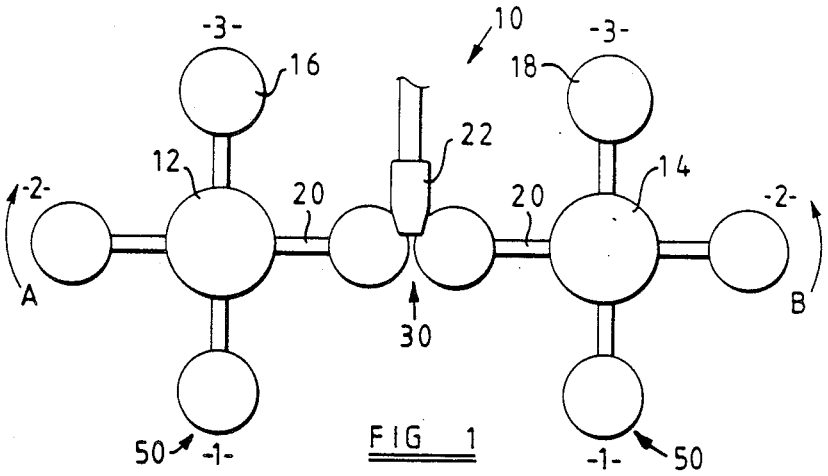
FIG. 1 is a diagrammatic plan view of an apparatus according to the present invention.

Referring to the drawings, FIG. 1 shows an apparatus 10 for flat seaming of garments such as panti-hose. The apparatus is used to seam a gusset into two halves of a pair of panti-hose and to seam the halves together (the halves being in tubular form with a foot portion formed at one end and a body portion and waistband at the other).

The apparatus comprises two spaced apart carousels 12, 14 each of which supports four rotatable heads 16, 18 equiangularly spaced about the carousel and conveniently mounted on radial support arms 20 extending from the carousel. Although each carousel is shown having four heads this is purely for convenience and the number could be varied if desired, as indeed could the number of sewing machines used.

The carousels 12 and 14 move the heads 16, 18 in opposite directions successively through a loading station 1, cutting station 2, fabric edge handling station 3 and seaming station 4 the heads 16, 18 are shown as moving the associated tables respectively clockwise and anticlockwise as shown by arrows A and B. The heads, themselves are also rotatable about their central axes, preferably in both directions, although as seen in FIG. 1 the heads 16 and 18 need only be rotatable respectively clockwise and anticlockwise. The carousels themselves are spaced apart such that as they rotate the heads about the carousels successive pairs of heads 16, 18 come into juxtaposition as shown in FIG. 1.

The apparatus has a seaming machine 22 positioned as shown at the seaming station 4 adjacent the juxtaposed pair of heads 16, 18 and housing a needle bar together with yarn take up and other actuating mechanisms (not shown in the drawings).

Figure 4:
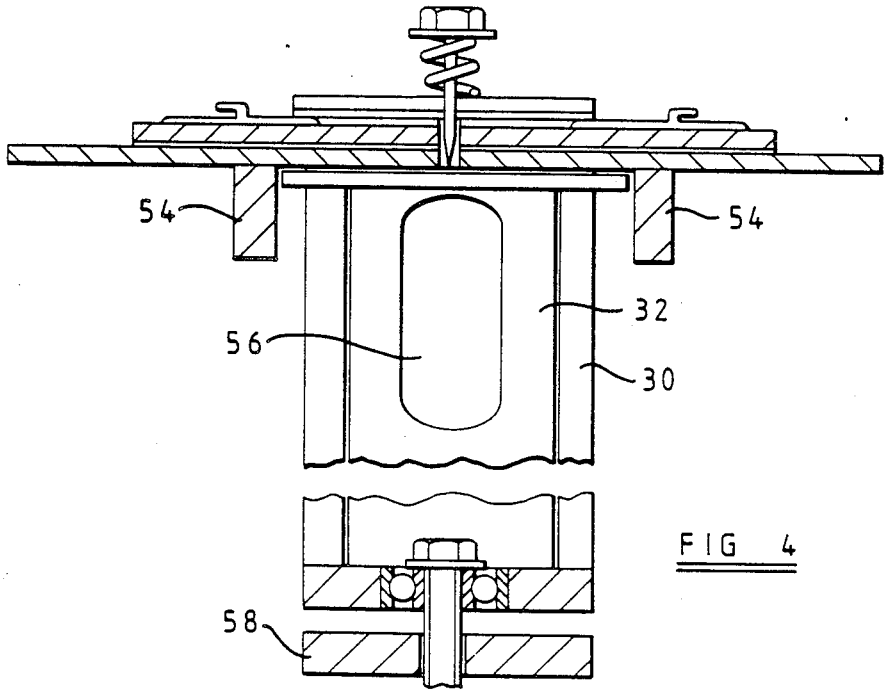
FIG. 4 is a front elevation, partially in section, of the head of FIG. 2 as seen in the direction of arrow A of FIG. 2.

FIGS. 2 to 4 show one head 16, 18 in more detail. The head comprises three plates 24, 26 and 28 which are generally co-planar with one another. The uppermost plate 24 is smaller than the intermediate plate 26, both of these plates being generally circular in shape. Plate 26 is rigidly secured to a support pillar 30 whilst plate 24 is rigidly secured to a support pillar 32. The pillars 30,32 are arranged in a generally vertical attitude with pillar 32 being slidably secured to pillar 30 such that the plate 24 can be raised and lowered relative to plate 26. The plates are secured to the pillars 30, 32 so that they lie in a generally horizontal attitude.

Plate 28 is generally elongate being tongue-like in shape and is slidably secured to the underside of pillar 26 such that it can be slid along its longitudinal axis between an inner, retracted position where it completely underlies plate 26 and an outer, extended position where it projects beyond the plate 26. The axis of plate 28 is arranged to pass through the rotional axis or centre of the plates 24 and 26.

As can be seen from the drawings, plate 24 is smaller than plate 26 and has two radially spaced arrays of inner and outer holes 34, 36, the holes in the inner and outer arrays being paired to receive respective ends of a plurality of pins 38. The inner end 40 of each pin 38 is located in a respective inner hole 34 and is retained by means of a spring-loaded member 42. The latter is resiliently biased against the pins 38 by means of a coil spring 44 whose compression force is adjustable by means of an adjusting nut 46.

The radially outer end of each pin 38 is formed with a point 48 which, in the normal position of the pin 38 passes through the associated hole 36 in the plate 24 and a respective co-operating hole 50 in the plate 26. In the lower position of the pin 38 as shown in FIG. 3 the point 48 projects just through the Plate 26.

As can be seen in FIG. 3 each of the pins 38 is formed with a lower cm surface 52 by means of which the point 48 of the pin can be raised out of the holes 36 and 50. As is described later, this allows the pins to be selectively engaged with fabric on the plates 24, 26 and this enables the stretch of the fabric to be varied at selected, critical positions.

Additional fabric stretchers in the form of ribs 54 are secured to the underside of the plate 26 and extend generally parallel with the plate 28. The ribs 54 serve to provide additional stretch to fabric which is drawn over the plate 26.

The support pillar 32 to which plate 24 is attached is provided with an opening 56 to allow a fabric cutting device such as scissors or a hot wire to be presented to the fabric when required, the device passing through the opening.

The whole of the head, as shown in FIG. 4, is rotatable by means of an indexing member 58.

The cycle of operation through stations 1, 2 and 3 is the same for each carousel and therefore the cycle of operation for only one head is described below.

Figure 5:
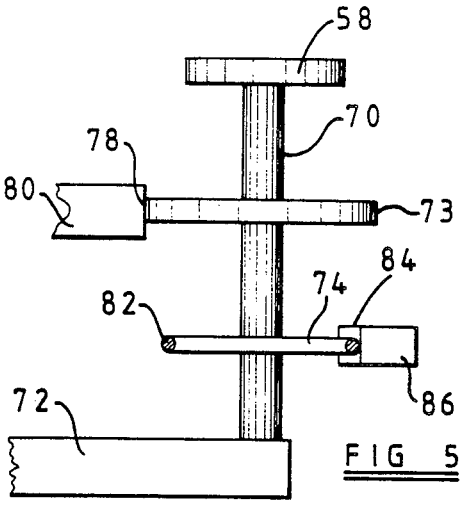
FIG. 5 is a side elevation of a rotatable support for a head.
Figure 6:
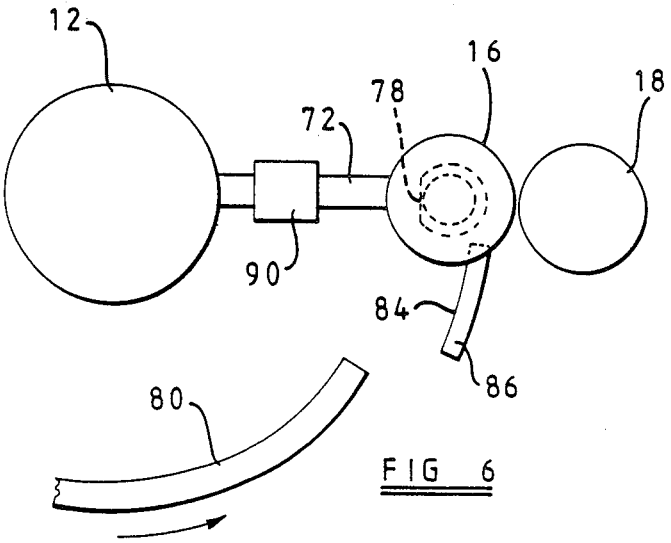
FIG. 6 is a more detailed plan view of one carousel and head of the apparatus of FIG. 1 at station four.

FIGS. 5 and 6 illustrates one method of rotating head 16 during indexing from station to station in more detail. The indexing member 58 is supported on a vertical shaft 70 which in turn is rotatably supported by an associated support arm 72. The shaft 70 also carries a plate cam 73 and a drive plate 74 axially spaced in and secured to the shaft 70.

The cam 73 has a cutaway portion forming an arcuate cam edge 78 which is concave in the plane of the plate cam. This cam edge co-operates with an open ring member 80 which is concentric with the path of the tables 16 but does not extend through the seaming station 4. The ring member 80 is of a radius such that during movement of the table 16 around the carousel the cam edge 78 contacts and rides along the ring member 80, maintaining the table 16 stationary relative to the carousel. That is, the same edge portion of the table always faces the carousel during movement of the cam edge along the ring member.

Conveniently, the cam edge 78 is formed by an insert of low friction material such as PTFE with the ring also being of or having a surface of a low friction material.

The drive plate 74 has a ring 82 fixed to its radially outer surface, preferably in a peripheral groove with the ring being of resilient material and retained in position by its reslience.

The ring is of a high friction material and co-operates with an arcuate cam surface 84 of a further cam 86. The arcuate cam surface 84 is also parallel with the path of the tables 16 and extends between the end of the ring member 80 and the seaming station 4. During movement of the table 16, when the cam edge 78 of the cam plate 72 clears the ring member 80 the ring 82 contacts the cam surface 84 and rolls along it, rotating the table 16 clockwise to position angularly the table exactly as required at the seaming station.

The garment to be seamed would normally be a stocking forming one half of a pair of panti-hose and the upper, open portion of the leg is drawn over the plate 26 from the right hand side. The plate 24 is in a raised position clear of plate 26. The latter has a stop line on the upper surface of the table and serving to ensure accurate positioning of the stocking on the plate 26.

In use, the waistband and body portions of the two stockings whose edges are to be flat seamed together are positioned by an operator on respective heads 16, 18 at loading stations 1. At this point both the needles 38 and the stretch member 28 of each head are retracted. The body portion of the stocking is drawn over plate 26 of the head until the waistband meets the stop line. The stocking leg portion is folded over the top of the body portion and drawn into a suction tube which opens into the plate 26 at an opening 68, the suction tube passing to one side of the opening 56 in the pillar 32.

The plate 24 is then lowered onto plate 26 so that the pins pass through the stocking fabric and the holes 50 in plate 26. The stocking fabric is therefore gripped on the upper surface of plate 26 between the two plates.

Figure 7:
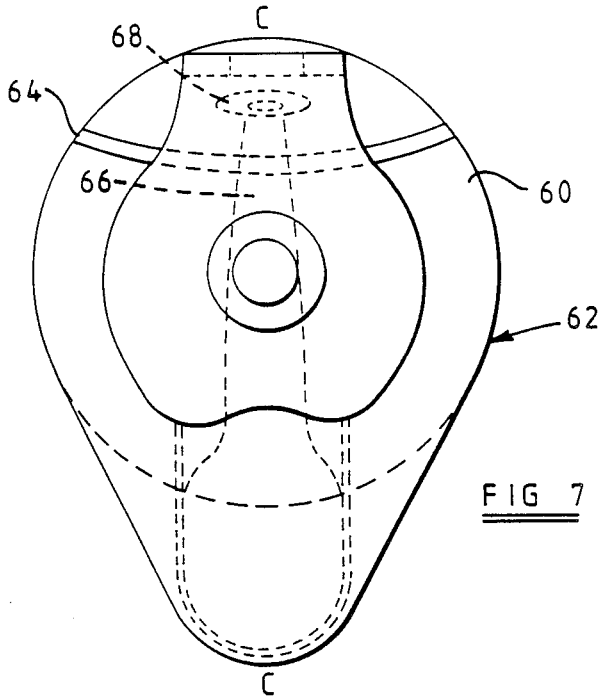
FIG. 7 is a plan view of the head of FIG. 2 with a stocking mounted on the head.

The head 16 is then moved into the cutting station 2 where the stretch member 28 is extended (FIG. 7). This has the effect of stretching the fabric on the underside of plate 26 which is not held by the pins 38.

The fabric is then opened by the cutting device, preferably a scissor device, on the underside of the plate 26 along a line extending from the waistband to a position adjacent the front of the plate 26 and, because the fabric is under tension, the opened edges resile to the radial edge of the plate.

Figure 10:
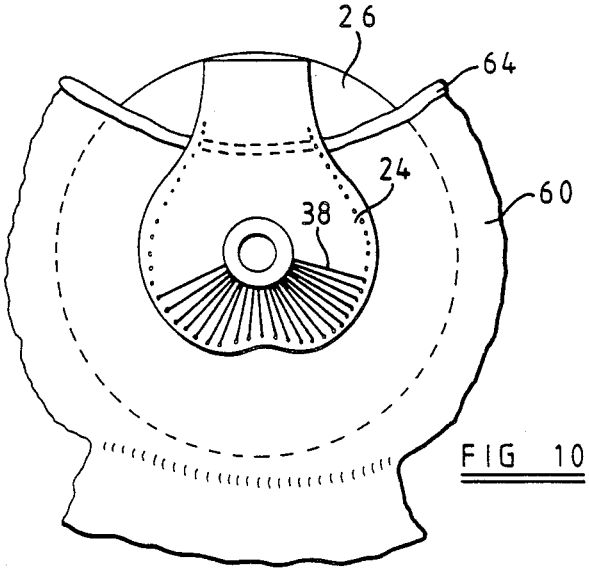
FIG. 10 shows a gusset piece seamed to a stocking.

At the third station 3 the opened edges of the fabric are moved generally into the same plane as the fabric on the upper surface of the plate 26 (FIG. 10). This is easily effected by suitable means such as air jets. The fabric is still retained on the plate by the pins 38.

The head 16 is then moved into the seaming station 4 while at the same time the co-operation of the drive plate 74 and the cam surface 84 rotates the head so that one opened edge of the fabric at the waistband is brought into juxtaposition with the correspondiong position of the stocking on the co-operating held 18 at the seaming station. Simultaneous rotation of the two heads 16, 18 in opposite directions and at the same speed is effected to enable the seaming machine 22 to seam together the adjacent open edges of the two panti-hose halves in one operation.

As the two tables rotate, at about the point of stitching each pin nearest the seaming machine throat plate is raised momentarily to allow the seamed part of the garment to be cast away from the plates.

Preferably, at the seaming station the positions of the waistbands of the two stockings are detected by photocells and further rotational adjustment of the heads 16, 18 is effected, where necessary, by auxiliary motors 62 to ensure accurate alignment of the two fabric halves.

Figure 8:
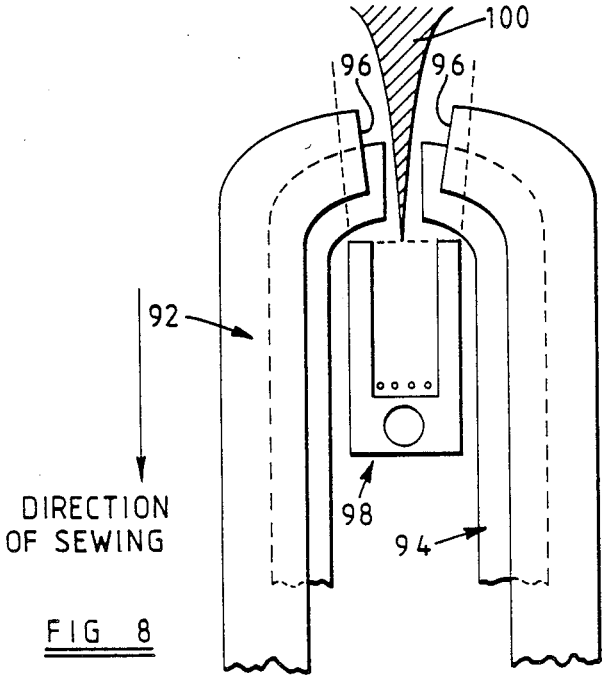
FIG. 8 is a plan view of a positioning device.

During the seaming operation manipulation of the fabric edges for accurate positioning can be effected conveniently by air jets, fabric guides, vacuum suction and/or other positioning device. One preferred form of positioning device is shown in plan view in FIG. 8. The device comprises two pairs of vertically spaced tongues 92,94. Each tongue is formed from an elongate strip of generally rigid material such as plastics material, each tongue having an end portion, turned towards the other tongue of the pair and ending in a gripping edge 96. The tongues of each pair are pivotable in a generally horizontal plane towards and away from one another. The tongues of each pair also are movable in both directions along their longitudinal axes. When these two movements are combined the result is that each tongue moves in a generally oval path with the left hand tongue of each pair moving in a clockwise direction as seen in FIG. 8 and the right hand tongue moving in an anti-clockwise direction. The movement of the pairs of tongues is synchronised so that when the upper pair are moving downwardly along their axis i.e. in the direction of arrow D in FIG. 8 the lower pair of tongues are moving in the reverse direction. During seaming, therefore, as the fabric edges move towards the throat plate and presser foot 98 of the seaming machine the upper tongues move towards one another to move and hold the fabric edges towards and against an upright member 100 by means of their gripping edges 96. As the fabric continues to move, the upper tongues move with the fabric edges, holding and guiding the fabric edges during seaming. When the upper tongues have completed their downward movement prior to pivoting way from one another, the lower pair of tongues have completed their upward movement and move inwards, towards one another to move and hold the fabric edges against the member 100. This cycle continues during seaming, ensuring that the fabric edges are fed into the seaming machine at the correct feeding speed.

The above operation describes the seaming together of two stockings to form panti-hose without a gusset being seamed into the panti-hose. The seaming of a gusset into panti-hose is a two cycle operation.

Figure 9:
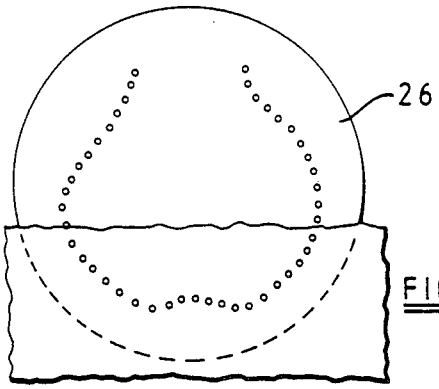
FIG. 9 is a plan view of the table of FIG. 2 mounting a gusset piece.

At position one, a single stocking is loaded onto one head 18 whilst the corresponding head 16 is provided with a gusset piece (FIG. 9) rather than another stocking. The gusset piece may be a separate, individual gusset piece or dispensed from a continuous role of gusset material. After the gusset piece is loaded on plate 26 as shown in FIG. 9 the plate 24 is lowered to secure the gusset in place by means of the pins 38. As the head 16 is moved through the second and third stations the gusset is unaffected whilst the stocking on head 18 is operated on in the normal manner as previously described. At the seaming station the heads 16,18 are rotated as described above and the gusset on head 16 is seamed to the stocking on head 18 along a portion of the cut edge of the stocking. The prior positioning of the gusset on the plate 26 of head 16 at the loading station ensures that it is seamed to the stocking in the correct position.

Figure 11:
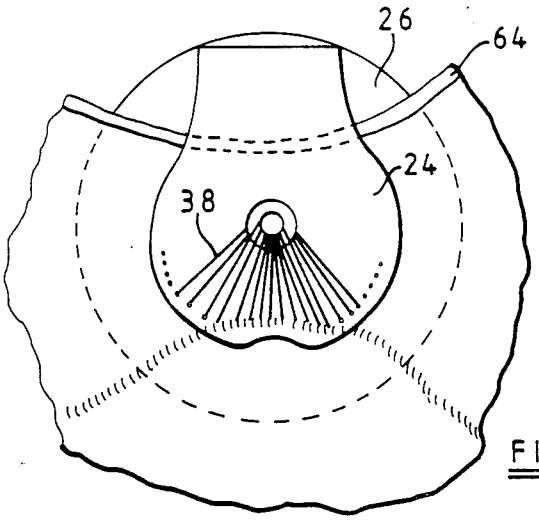
FIG. 11 shows the stocking and gusset piece of FIG. 10 adjusted in position.

During seaming, the pins 38 holding the gusset in position are raised sequentially as previously described to allow the gusset to be drawn from the plate 26. However, the pins holding the stocking are not effected so that the stocking is retained in position on the head 18 with the gusset which is consequently transferred to the head 18. The heads 18, 16 are then indexed once again to the loading stations 1 to begin the second cycle. A second stocking is loaded onto the empty head 16 whilst on the head 18, the pins 38 extending through an arc 40 are raised to allow the stocking-gusset seam to be repositioned from its initial position as shown in FIG. 10 to the position in FIG. 11. The heads 16,18 are then indexed through stations 2 and 3 to station 4. At stations 2 and 3, no operation is carried out on the combined stocking and gusset on head 18, whilst the stocking on head 16 is treated at stations 2 and 3 as previously described. At station 4, the two fabric pieces are seamed together, again as previously described, and the completed garment drawn from the heads during seaming.

Figure 12:
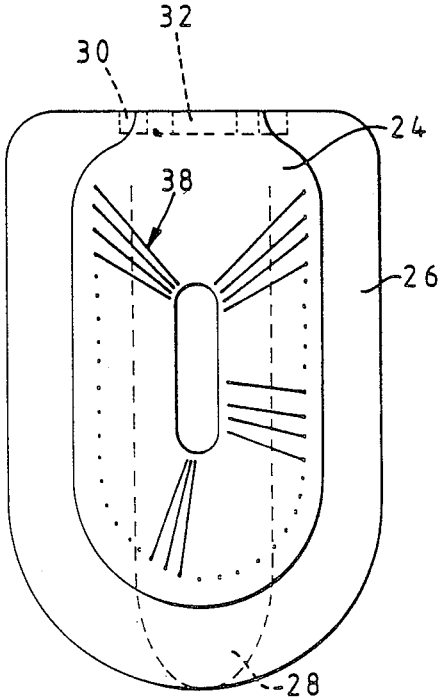
FIG. 12 shows a modified form of head.

By varying the profile of the head which may be circular, or oval or of a "U-form" design then the invention can be used to apply varying shapes of gusset such as U-form gussets to panti-hose. FIG. 12 shows a modified form of head which is used for U form gussets. As can be seen, the plates 24 and 26 are generally elongate or rectangular in shape, compared with the circular plates of FIG. 2. The array of holes for the needles 38 is arranged in a corresponding shape, but in other respects the head of FIG. 12 is generally as described with reference to the previous Figures. The seaming method and operation would be as previously described with reference to FIGS. 1 to 11. However, compensating mechanisms would be required to ensure that the fabric edges which are being seamed together are maintained in juxtaposition.

The seaming machine may be, e.g. a Union Special flat seaming machine with gantry mounting.

It will be appreciated that rotational movement of the heads 16, 18 is arranged to provide the desired co-ordinated movement between the two heads to allow flat seaming of garment edges to be effected automatically.

I claim:

1. An apparatus for flat seaming together two garment portions such as a panti-hose half and a gusset, comprising:

first carrier means for supporting the body portion of said panti-hose half;

second carrier means for supporting said gusset;

a respective support means for supporting said first and second carrier means and moving said first carrier means successively through a loading station, an opening station and a seaming station and moving said second carrier member through a loading station and said seaming station;

respective clamping means for gripping said gusset and said body portion of said panti-hose half to the respective carrier means;

means at said opening station for opening said body portion along a preselected line extending from a waistband of said body portion to form an opening in said body portion;

means at said seaming station for seaming together free edges of said gusset and said opening in said body portion; and moving means for bringing said first and second carrier means into juxtaposition to align said free edges with one another at a said seaming station and means for moving said carrier means relative to one another and to said seaming means to bring successive portions of said edges in juxtaposition during seaming to enable said seaming means to seam said edges together.

2. Apparatus as claimed in claim 1 wherein each said first and second carrier means comprises a carrier over which the garment portion is arranged to be drawn, and said clamping means comprises a clamping member movable between a first position remote from said carrier and a second position adjacent said carrier for retaining said garment portion therebetween.

3. Apparatus as claimed in claim 2 wherein said clamping means further comprises a plurality of members carried by said clamping members and displaceable between a first, retracted position clear of said garment portion and a second, extended position wherein said members are arranged to penetrate said garment portion and retain said portion in position.

4. Apparatus as claimed in claim 3 wherein said carrier is generally planar and each said member has a needle portion which in its extended position is arranged to pass through the material of said garment portion.

5. Apparatus as claimed in claim 4 wherein each said needle portion in its extended position engages in a respective locating recess in said carrier.

6. Apparatus as claimed in claim 3, wherein said member is biased towards said extended position and has a cam surface engageable by cam means for retracting said member.

7. Apparatus as claimed in claim 6 wherein said seaming station has cam means for successively retracting said members to enable removal of said seamed garment portions from said carrier.

8. Apparatus as claimed in claim 1 to wherein at least said first carrier means comprises means for extending a dimension of the carrier means after actuation of said clamping means and prior to actuation of said opening means to stretch the material of said body portion along said preselected line.

9. Apparatus as claimed in claim 1 wherein said moving means is operable to rotate each said carrier means about a central axis of said carrier means to align said free edges with one another and enable seaming of said edges to be effected.

10. Apparatus as claimed in claim 1 wherein said seaming station has means for manipulating said free edges for accurately aligning said edges for seaming.

11. Aparatus as claimed in claim 10 wherein said manipulating means comprises at least one pair of opposing guide members and control means for moving said guide members along preselected paths firstly towards one another to hold said free edges therebetween and secondly with said edges to retain said edges in alignment during seaming thereof.

12. Apparatus as claimed in claim 11 wherein each said path is a closed path and said control means is operable to move said guide members repeatedly along said paths.

13. Apparatus as claimed in claim 12 comprising two pairs of said guide member and wherein said control means is operable to move said pairs of guide members successively along said preselected paths.

14. Apparatus as claimed in claim 1, wherein each said support means comprises a carousel unit having a plurality of radially extending arms each carrying a respective one of said carrier means and each unit is operable intermittently to rotate each carrier means successively through said stations.

15. Apparatus as claimed in claims 1 wherein said support means is operable to move said second carrier means through an opening station intermediate said loading station and said seaming station.

* * * * *